United States Patent [19]

Kramer

[11] 3,958,989

[45] May 25, 1976

[54] TRANSPARENCY SUPPORT MATERIAL FOR ELECTROPHOTOGRAPHIC PROCESS

[75] Inventor: William E. Kramer, Fairport, N.Y.

[73] Assignee: Xerox Corporation, Stamford, Conn.

[22] Filed: Aug. 8, 1974

[21] Appl. No.: 495,698

Related U.S. Application Data

[62] Division of Ser. No. 367,608, June 6, 1973.

[52] U.S. Cl. ..... 96/1.2

[51] Int. Cl.[2] ..... G03G 5/12

[58] Field of Search ..... 96/1.2

[56] References Cited

UNITED STATES PATENTS

| | | | |
|---|---|---|---|
| 2,297,691 | 10/1942 | Carlson | 96/1.2 |
| 2,986,466 | 5/1961 | Kaprelian | 96/1.2 |
| 3,618,752 | 11/1971 | Barker et al. | 206/57 |

*Primary Examiner*—Mary F. Kelley
*Assistant Examiner*—L. Y. Falasco
*Attorney, Agent, or Firm*—H. Fleischer; J. J. Ralabate; C. A. Green

[57] ABSTRACT

A sheet of support material in which a non-fibrous image receiving portion has a fibrous portion secured thereto. The fibrous portion cooperates with a sheet feeding apparatus to facilitate the seriatim feeding of successive sheets of support material from a stack thereof.

The foregoing abstract is neither intended to define the invention disclosed in the specification, nor is it intended to be limiting as to the scope of the invention in any way.

4 Claims, 3 Drawing Figures

TRANSPARENCY SUPPORT MATERIAL FOR ELECTROPHOTOGRAPHIC PROCESS

This is a division of application Ser. No. 367,608, filed June 6, 1973.

BACKGROUND OF THE INVENTION

This invention relates generally to an electrostatographic printing machine, and more particularly concerns a sheet of support material utilized in the sheet feeding apparatus thereof.

In the process of electrostatographic printing, an electrostatic latent image is created which corresponds to the original document. The electrostatic latent image is reproduced in viewable form on a sheet of support material. Electrostatographic printing includes electrophotographic printing and electrographic printing. In the process of electrophotographic printing, as disclosed in U.S. Pat. No. 2,297,691 issued to Carlson in 1942, a photoconductive layer is charged to a substantially uniform potential in order to sensitize its surface. A light image of the original document is projected onto the charged photoconductive surface. The charge on the photoconductive surface is selectively dissipated in the irradiated areas to record thereon an electrostatic latent image of the original document. A developer mix comprising heat settable dyed, colored thermoplastic powder, known in the art as toner particles, and coarser carrier granules, such as ferromagnetic granules, is brought into contact with the electrostatic latent image. The toner particles are attracted electrostatically from the carrier granules to the latent image recorded on the photoconductive layer. Thereafter, the toner powder image developed on the photoconductive layer is transferred to a sheet of support material. The toner powder image is then permanently affixed to the support material. Electrographic printing differs from electrophotographic printing primarily in that an insulating medium is utilized to form, without the aid of a light image, the electrostatic latent image. Other than that, electrographic printing and electrophotographic printing are substantially identical to one another.

Multi-color electrophotographic printing is substantially the same as the heretofore discussed process for black and white printing. However, a plurality of single color toner powder images are formed and thereupon transferred to the sheet of support material in superimposed registration with one another to create a multicolor copy corresponding in color to the original document. The multicolor electrophotographic machine is generally provided with cut sheets of support material. The sheets are used as image receiving members in the printing machine. Although paper is the most commonly used sheet material, certain non-fibrous sheets characterized generally by having a high surface gloss and a smooth surface are increasingly utilized. These non-fibrous sheets are frequently more durable than paper and, when transparent, have great utility as transparencies, i. e. a conventional projector may project images therefrom onto a screen.

Generally, the sheet of support material is of a preselected size and advances through the printing machine, one sheet at a time, for suitable processing therein. Inasmuch as copies may be made at high speeds, it is advantageous to stack a pile of sheets in the printing machine feeding mechanism which automatically advances one sheet at a time therefrom. Sheets are continuously advanced from the stack until the stack is depleted, whereupon the operator refills the machine with a new stack of sheets. However, when non-fibrous sheet material is substituted for paper, operational difficulties frequently occur. For example, in feeding successive non-fibrous sheets, it has been found that the uppermost sheet often causes creep or advancement of the sheets immediately therebelow. This results in misfeeds and jams within the printing machine, thereby greatly increasing the amount of wasted sheets and the ensuing cost of the operation. In addition, machine downtime, i. e. the time necessary to clear the machine of sheet jams, is substantially increased when misfeeds or jams occur. It appears that jams or misfeeds are primarily caused by the relatively high sliding friction between successive non-fibrous sheets.

As hereinbefore mentioned, the utilization of non-fibrous sheets for the formation of multi-color transparencies is highly significant with the advent of multicolor printing. In multi-color electrophotographic printing machines, it is highly desirable to have the capability of creating multi-color transparencies. Hence, there is a continuing need for trouble-free feeding and processing of the non-fibrous sheet material.

Accordingly, it is a primary object of the present invention to improve the transparency support material so that successive sheet feeding thereof is readily achieved.

SUMMARY OF THE INVENTION

Briefly stated, and in accordance with the present invention, there is provided a sheet of support material arranged to be employed in the sheet feeding apparatus of an electrostatographic printing machine.

In the present instance, the sheet of support material includes an image receiving portion and a fibrous portion. Preferably, the image receiving portion is made from a substantially transparent, non-fibrous material. The trailing marginal region of the fibrous portion is secured to the leading marginal region of the image receiving portion. In this manner, the fibrous portion extends in an outwardly direction from the image receiving portion and cooperates with the sheet feeding apparatus to facilitate the seriatim feeding of successive sheets of support material from a stack thereof.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
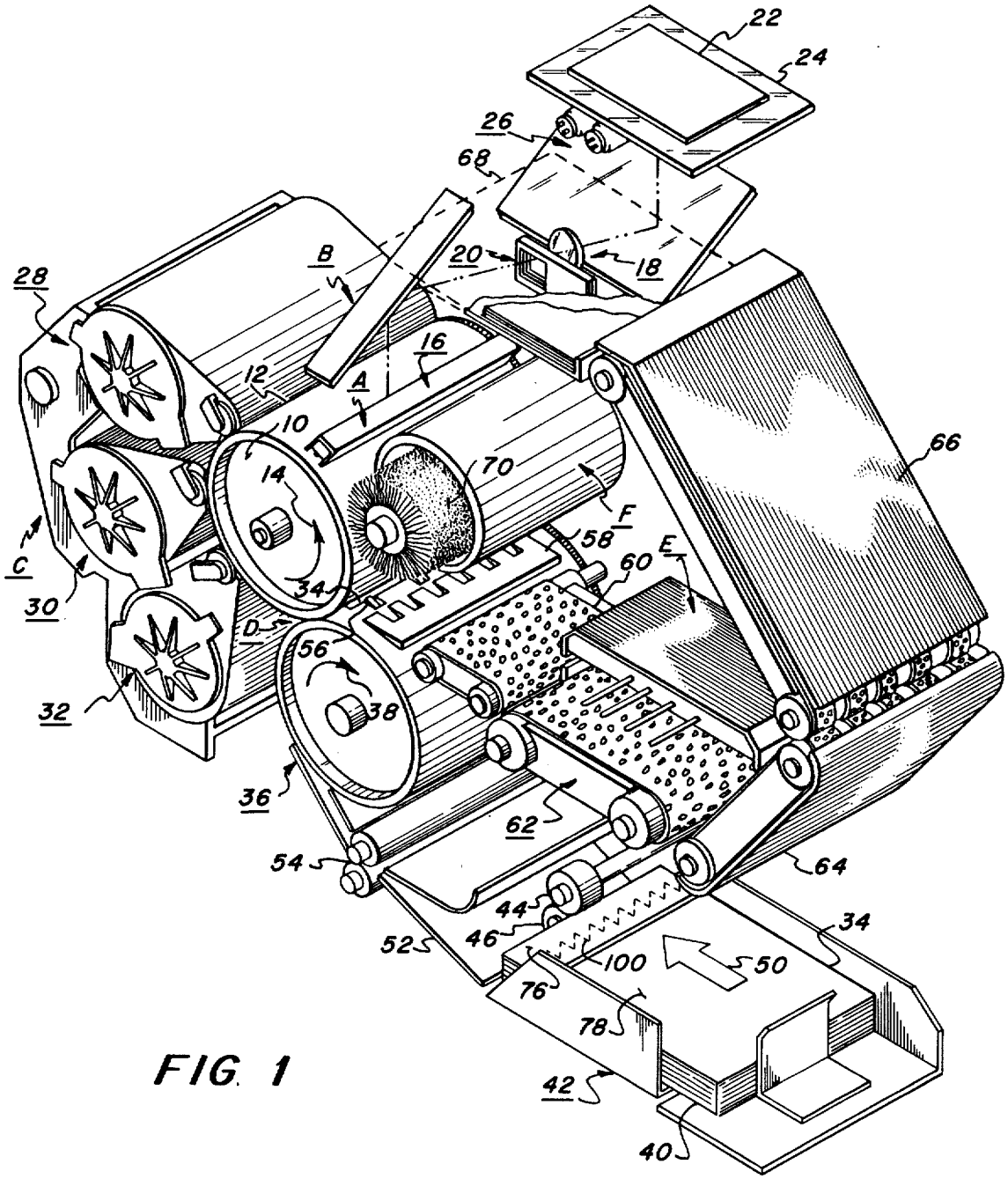
FIG. 1 is a schematic perspective view of a multicolor electrophotographic printing machine utilizing the support material of the present invention therein.

For a general understanding of the disclosed multicolor electrophotographic printing machine in which the support material of the present invention may be utilized, continued reference is had to the drawings. In the drawings, like reference numerals have been used throughout to designate like elements. Referring now to FIG. 1, the various components of the multi-color printing machine are depicted schematically thereat. Although the support material of the present invention is particularly well suited for use in this type of an electrophotographic printing machine, it should become evident from the following discussion that it is equally well suited for use in a wide variety of electrostatographic printing machines, and is not necessarily limited to the particular embodiment shown herein.

As depicted in FIG. 1, the electrophotographic printing machine utilizes a drum 10 having a photoconductive surface 12 secured to the exterior circumferential surface and entrained thereabout. Drum 10 is mounted rotatably on the machine frame and driven, in the direction of arrow 14, at a substantially constant angular velocity by a drive motor (not shown). As drum 10 rotates, photoconductive surface 12 passes sequentially through a series of processing stations. The drive motor rotates drum 10 at a predetermined speed relative to the other operating mechanisms of the printing machine. A timing disc mounted in the region of one end of the shaft of drum 10 cooperates with the machine logic to synchronize the various operations with the rotation of drum 10. This produces the proper sequence of events at the respective processing stations.

First, drum 10 rotates photoconductive surface 12 through charging station A. At charging station A, a corona generating device, indicated generally at 16, extends longitudinally in a transverse direction across photoconductive surface 12. This readily permits corona generating device 16 to spray ions onto photoconductive surface 12 to produce a relatively high, substantially uniform charge thereon. Preferably, corona generating device 16 is of the type described in U.S. Pat. No. 2,778,946 issued to Mayo in 1957.

With continued reference to FIG. 1, after photoconductive surface 12 is charged to a substantially uniform potential, drum 10 is rotated to exposure station B. At exposure station B, a color filtered light image of original document 22 is projected onto charged photoconductive surface 12. Exposure station B includes a moving lens system, generally designated by the reference numeral 18, and a color filter mechanism, shown generally at 20. A suitable moving lens system is disclosed in U.S. Pat. No. 3,062,108 issued to Mayo in 1962. Original document 22, such as a sheet of paper, book or the like is placed face down upon transparent viewing platen 24. Lamps 26 are adapted to move in a timed relationship with lens 18 and filter mechanism 20 to scan successive incremental areas of original document 22 disposed upon platen 24. This creates a flowing light image of original document 22 which is projected onto photoconductive surface 12. During the exposure process, filter mechanism 20 interposes selected color filters into the optical light path of lens 18. The appropriate filter operates on the light rays transmitted through lens 18 to record an electrostatic latent image on photoconductive surface 12 corresponding to a preselected spectral region of the electromagnetic wave spectrum, hereinafter referred to as a single color electrostatic latent image.

Next, drum 10 rotates to development station C. At development station C, three individual developer units, generally indicated by the reference numerals 28, 30, and 32, respectively, are arranged to render visible the electrostatic latent image recorded on photoconductive surface 12. Preferably, the developer units are all of a type generally referred to as magnetic brush developer units. A typical magnetic brush developer unit employs a magnetizable developer mix which includes carrier granules and toner particles. Generally, the toner particles are heat settable. In operation, the developer mix is continually brought through a directional flux field to form a brush thereof. The electrostatic latent image recorded on photoconductive surface 12 is brought into contact with the brush of developer mix. Toner particles are attracted from the carrier granules of the developer mix to the latent image. Each of the developer units contain appropriately colored toner particles corresponding to the complement of the spectral region of the wave length of light transmitted through filter 20. For example, a green filtered electrostatic latent image is developed by depositing green absorbing magenta toner particles thereon. Similarly, blue and red filtered latent images are developed with yellow and cyan toner particles, respectively.

After development, the now visible toner powder image is advanced to transfer station D. At transfer station D, the toner powder image adhering electrostatically to photoconductive surface 12 is transferred to a sheet of support material 34. Support material 34 will be described hereinafter in greater detail with reference to FIGS. 2 and 3. A transfer roll, shown generally at 36, secures support material 34 releasably thereto for movement in a recirculating path therewith. Transfer roll 36 is adapted to rotate in the direction of arrow 38, in synchronism with drum 10 (in this case at substantially the same angular velocity therewith). This enables a plurality of toner powder images to be transferred from photoconductive surface 12 to support material 34. Each of the toner powder images are superimposed in registration with the prior one. Image transfer is achieved by electrically biasing transfer roll 36 to a potential having sufficient magnitude and the proper polarity to attract electrostatically toner particles from the latent image recorded on photoconductive surface 12 to support material 34. U.S. Pat. No. 3,612,677 issued to Langdon et al. in 1971 describes a suitable electrically biased transfer roll.

The foregoing processes of charging, exposing, developing and transferring are repeated a plurality of cycles (in this case three) to produce a multi-color copy corresponding to the colored original document.

Referring now to the sheet feeding arrangement, sheet 34 is advanced from a stack 40 thereof. Stack 40 is disposed in the sheet feeding apparatus employed in the electrophotographic printing machine, indicated generally by the reference numeral 42. Sheet feeding apparatus 42 will be described in greater detail hereinafter with reference to FIG. 2. As shown in FIG. 1, feed roll 44 cooperates with retard roll 46 to advance successive uppermost sheets 34 in the direction of arrow 50. Uppermost sheet 34 advances into chute 52 which directs it into the nip of register rolls 54. Register rolls 54 align and forward sheet 34 to gripper fingers 56 mounted on transfer roll 36. Gripper fingers 56 secure releasably sheet 34 on transfer roll 36 for movement in a recirculating path therewith.

After a plurality of toner powder images have been transferred to image receiving portion 78 of support material 34, gripper fingers 66 release sheet 34 and stripper bar 58 separates support material 34 from transfer roll 36. Sheet material 34 is stripped from transfer roll 36 and transported on endless belt conveyor 60 to fixing station E.

At fixing station E, fusing apparatus 62 permanently affixes the multi-layered toner powder image to image receiving portion 78 of support material 34. One type of suitable fuser is described in U.S. Pat. No. 3,498,592 issued to Moser et al. in 1970. Support material 34, with the toner powder image affixed to image receiving portion 78, is, thereafter, advanced by conveyors 64 and 66 to catch tray 68. Catch tray 68 is arranged to permit the machine operator to readily remove the completed multi-color copy from the printing machine. After support material 34 is removed from the printing machine, fibrous portion 76 is separated from image receiving portion 78.

The last processing station in the direction of rotation of drum 10, as indicated by arrow 14, is cleaning station E. As heretofore indicated, a preponderance of the toner particles are transferred to image receiving portion 78 of support material 34, however, some residual toner particles remain on photoconductive surface 12. Cleaning station D removes the residual toner particles from photoconductive surface 12. The residual toner particles are initially brought under the influence of a cleaning corona generating device (not shown) adapted to neutralize the electrostatic charge remaining on the toner particles and photoconductive surface. Thereafter, the neutralized toner particles are cleaned from photoconductive surface 12 by a rotating fibrous brush 70. One type of suitable brush cleaning device is described in U.S. Pat. No. 3,590,412 issued to Gerbasi in 1971.

It is believed that the foregoing description is sufficient for purposes of the present application to illustrate the general operation of an electrophotographic printing machine embodying therein the teachings of the present invention.

Figure 2:
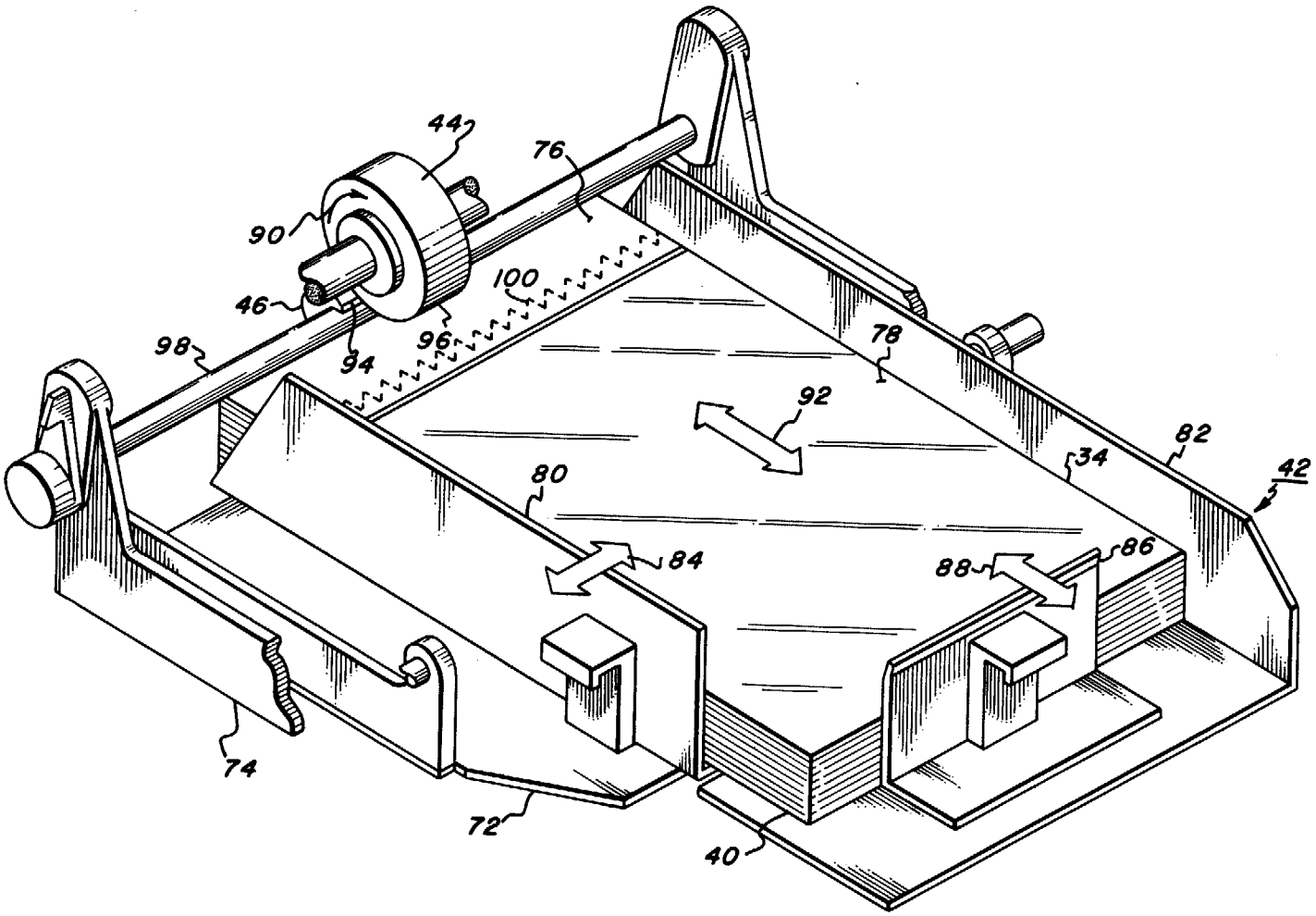
FIG. 2 is an enlarged perspective view illustrating the sheet feeding apparatus of the FIG. 1 printing machine with a stack of support material disposed therein.

Referring now to the sheet feeding apparatus illustrated in FIG. 2, support material 34 will be discussed in conjunction therewith. As shown in FIG. 2, sheet feeding apparatus 40 including a sheet tray, indicated by the reference numeral 72, mounted pivotably on frame member 74. Frame member 74 is secured fixedly to the printing machine. Sheet tray 72 pivots in a clockwise direction so that the fibrous portion 76 of the uppermost sheet of support material 34 engages feed roll 44. Fibrous portion 76 is adhesively secured to image receiving portion 78 of uppermost sheet 34. Support material 34 will be described hereinafter in greater detail with reference to FIG. 3. A pair of springs (not shown) resiliently urge sheet tray 72 to pivot in a clockwise direction. Sheet tray 72 is of a generally planar configuration for supporting stack 40 thereon. Stack 40 is positioned on sheet tray 72 by means of margin guides 80 and 82 and rear guide 86. Margin guide 80 is adapted to move in the direction of arrow 84 so as to be adjustable for accommodating various stack widths thereon. Rear guide 86 is mounted slidably on tray 72 by suitable means and moves in the direction of arrow 88 so as to be adjustable lengthwise for any size stack supported thereon. This type of arrangement permits the sheet feeding apparatus to accommodate support material varying in width from 8 to 8½ inches and in length from 10 to 14 inches. Feed roll 44 is driven by a suitable motor (not shown) in the direction of arrow 90 to advance successive uppermost sheets 34 in the direction of arrow 92. Initially, feed roll 44 engages fibrous portion 76 of support material 34 to advance it between retard roll 46 and feed roll 44. Feed roll 44 has a first portion 94 engaging retard roll 46 simultaneously with a second portion 96 engaging fibrous portion 76 of support material 48. Retard roll 46 is mounted eccentrically on shaft 98. Shaft 98 is mounted rotatably within the printing machine frame and is adapted to pivot retard roll 46 from a first position spaced from feed roll 44 to a position in engagement therewith.

With continued reference to FIG. 2, there is shown a sheet of support material 34 being advanced by feed roll 44 cooperating with retard roll 46. As shown therein, retard roll 46 is in engagement with feed roll 44. Feed roll 44 rotates in the direction of arrow 90 to advance fibrous portion 76 of support material 34 between retard roll 46 and feed roll 44. Thereafter, the entire sheet of support material 34 is advanced to transfer roll 36 as heretofore described. The toner powder image is transferred to image receiving portion 78 of support material 34. After a multi-layered toner powder image has been permanently affixed to image receiving portion 78 of support material 34, fibrous portion 76 is separated therefrom. This is achieved by tearing fibrous portion 76 along serrated edge portion 100.

Figure 3:
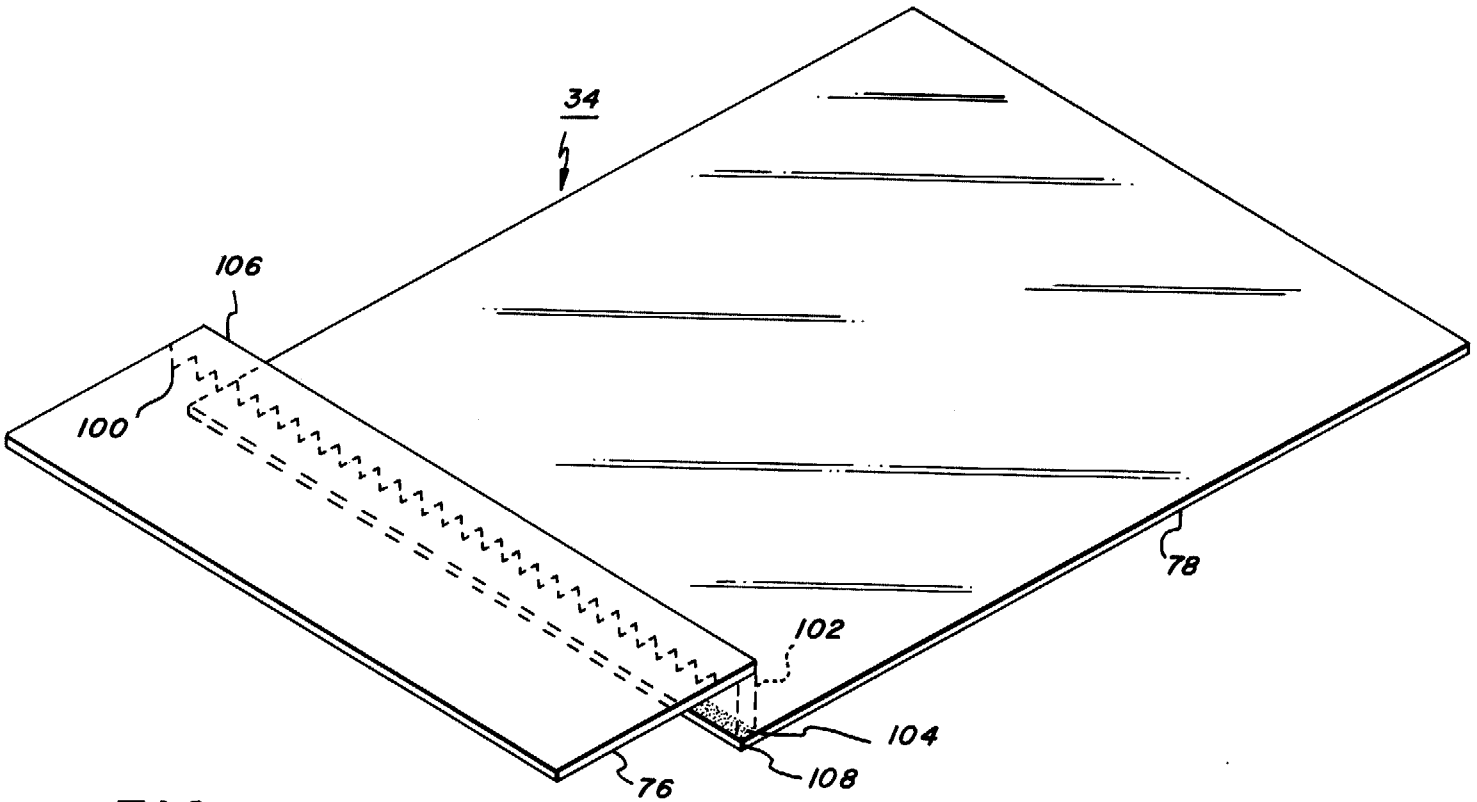
FIG. 3 is an enlarged perspective view of the FIG. 2 support material.

Turning now to FIG. 3, there is shown a sheet of support material 34 arranged to be advanced by sheet feeding apparatus 42 from stack 40 to the various processing stations of the electrophotographic printing machine depicted in FIG. 1. Preferably, image receiving portion 78 of sheet 34 is a polysulfone thermoplastic material which is available in sheets of approximately 4 mils thickness under the trademark Rowlex from Roland Products, Inc., Kensington, Conn. This material, in sheet form, is very transparent and may be processed satisfactorily to receive thereon a high quality colored image corresponding to the original document to be reproduced. Another polymeric non-fibrous material suitable for use herein as image receiving portion 78 is polyethylene terephthalate polyester transparent sheet material available under the trademark Mylar from the E. I. duPont Nemours Co. and is available in a wide range of thicknesses. Many other transparent, non-fibrous, polymeric materials are available in the art which may be formed into a film to receive multi-color images thereon. Any suitable polymeric material selected from a group of resins consisting of polysulfones, polyethylenes, phenylenes, and polycarbonates may be so utilized.

preferably, fibrous portion 76 is made from a suitable paper, i.e. 20 to 24 lb. weight bond paper. Fibrous portion 76 overlaps image receiving portion 78 approximately 3/16 of an inch in region 102. Serrated edge 100 is closely adjacent to the leading marginal region of image receiving portion 78. As shown in FIG. 3, trailing marginal region 106 of fibrous portion 76 overlaps the leading marginal regional 108 of image receiving portion 78 in region 102. Preferably, non-fibrous portion 76 is substantially the same width as image receiving portion 78. Image receiving portion 78 is, preferably, an 8½ × 11 sheet of non-fibrous substantially transparent material. Fibrous portion 76 is, preferably, 3 inches in length. In this way, the total composite length of support material 34 is approximately 14 inches. Hence, the size of the support material is suitable for utilization in sheet feeding apparatus 42 without any modifications therein as the normal adjustments thereof are capable of handling support material of this size. Moreover, the printing machine itself, is designed to handle conventional copy paper which ranges in length from 11 inches to 14 inches. Thus, the composite support material heretofore described would require no machine modifications to be utilized therein. The length of non-fibrous portion 76 may range from 1 to 3 inches, though it is preferably about 3 inches long. As heretofore indicated, fibrous portion 78 is adhesively secured to image receiving portion 78 in overlap region 102. A suitable adhesive 104 is initially applied to the trailing marginal region 108 of fibrous portion 76. The adhesive is allowed to substantially dry and then the fibrous portion 76 is placed on one surface of image receiving portion 78 overlapping leading edge 108 of image receiving portion 78 by about 3/16 of an inch. The preferred approach for adhesively securing fibrous portion 76 to image receiving portion 78 is to overlap leading marginal region 108 of image receiving portion 78 with trailing marginal region 106 of fibrous portion 76. Thereafter, trailing marginal region 106 of fibrous portion 76 is coated with a Flow-Set solvent. The solvent is allowed to evaporate and subsequently thereto fibrous portion 76 is serrated at leading edge 102 of image receiving portion 78. This enables fibrous portion 76 to be discarded after the toner image is permanently affixed to image receiving portion 78.

When a plurality of sheet of support material 34 are stacked, successive image receiving portions 78 are separated from one another by fibrous portions 76. The separation of non-fibrous portions 78 by fibrous portions 76 of successive sheets of support material 34 reduces the sliding friction therebetween. Hence, the reduction of the sliding friction between successive sheets of support material simplifies separation and advancement of successive sheets.

From the foregoing it is apparent that the sheets support material of the present invention cooperate with the sheet feeding apparatus of an electrostatographic printing machine. This improves seriatim feeding of successive uppermost sheets from a stack of support material disposed in the sheet feeding apparatus. In particular, the sheets of support material are adapted to reduce the sliding friction between the non-fibrous portions thereof by interposing fibrous portions between successive non-fibrous portions. Thus, the present invention facilitates the automatic feeding of successive sheets of support material adapted to be utilized in electrostatographic printing machines for the formulation of colored transparencies.

It is, therefore, evident that there has been provided in accordance with this invention, a sheet of support material cooperating with a sheet feeding apparatus for preventing mis-feeding of sheets from a stack thereof that fully satisfies the objects, aims and advantages set forth above. While this invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A method of creating multi-color transparencies by an electrophotographic printing process, including the steps of forming a image receiving sheet from a substantially transparent, non-fibrous material, said material having high sliding friction between successive sheets:

overlapping the leading marginal region of an image receiving sheet with the trailing marginal region of a fibrous sheet;

securing adhesively the image receiving sheet to the fibrous sheet in the overlapped region such that the fibrous sheet extends over a portion of the image receiving sheet in an outwadly direction therefrom;

charging a photoconductive surface to a substantially uniform potential;

projecting a filtered light image onto the charged photoconductive surface to record thereon an electrostatic latent image corresponding to a single color of the original document;

depositing a toner powder, complementary in color to the filtered light image, on the electrostatic latent image in image configuration;

transferring the toner powder image from the elctrostatic latent image recorded on the photoconductive surface to the image receiving sheet;

repeating said steps of charging, projecting, depositing, and transferring for at least one other color of the original document;

fixing the multi-layered toner powder images substantially permanently to the image receiving sheet; and separating the fibrous sheet from the image receiving sheet after said step of fixing.

2. A method as recited in claim 1, wherein said step of overlapping includes the step of positioning the trailing marginal region of the fibrous sheet on the leading marginal region of the image receiving sheet such that the overlap region is preferably about 3/16 of an inch.

3. A method as recited in claim 2, further including the step of cutting the fibrous sheet to a width substantially equal to the width of the image receiving sheet and to a length ranging from about 1 to about 3 inches, the length preferably being about 3 inches.

4. A method as recited in claim 1, wherein said step of forming the image receiving sheet includes selecting a substantially transparent synthetic thermoplastic film selected from a group of resins consisting of polysulfones, polyethylenes, phenylenes and polycarbonates.

* * * * *